US005544793A

United States Patent [19]

Harrop

[11] Patent Number: 5,544,793

[45] Date of Patent: Aug. 13, 1996

[54] FOLDING CHAIR BACKPACK

[76] Inventor: Kathy L. Harrop, 2026 W. 66th St., Davenport, Iowa 52806

[21] Appl. No.: 412,245

[22] Filed: Mar. 28, 1995

[51] Int. Cl.[6] ..... A45F 3/04

[52] U.S. Cl. ..... 224/645; 224/155; 224/153; 297/17; 297/183.5

[58] Field of Search ..... 224/151, 153–156, 224/209, 210, 211; 297/129, 17, 183.5; D12/416

[56] References Cited

U.S. PATENT DOCUMENTS

| | | | |
|---|---|---|---|
| D. 338,779 | 8/1993 | Albert | D12/416 |
| 3,027,058 | 3/1962 | Huber . | |
| 3,319,852 | 5/1967 | Perkins | 224/901 |
| 4,428,514 | 1/1984 | Elf . | |
| 4,487,345 | 12/1984 | Pierce et al. . | |
| 4,574,990 | 3/1986 | Remis . | |
| 4,739,913 | 4/1988 | Moore . | |
| 4,925,071 | 5/1990 | Fleming et al. | 224/210 |
| 4,972,981 | 11/1990 | Gex . | |
| 5,016,792 | 5/1991 | Jay | 224/155 |
| 5,131,575 | 7/1992 | Charest . | |
| 5,139,308 | 8/1992 | Ziman | 297/129 |
| 5,297,708 | 3/1994 | Carpenter . | |
| 5,323,943 | 6/1994 | Elledge . | |

OTHER PUBLICATIONS

Journal of The American Medical Association vol. 168, No. 7, Oct. 18, 1958.

*Primary Examiner*—Henry J. Recla
*Assistant Examiner*—Gregory M. Vidovich
*Attorney, Agent, or Firm*—Henderson & Sturm

[57] ABSTRACT

A device for attachment to a standard folding lawn chair for subsequent transportation on an individual's back. The device utilizes a padded sleeve which slips over the back of the chair, and within which are a pair of fasteners which are secured to the seatback upper-crossmember. A pair of shoulder straps, integral with the fasteners, extend from the padded sleeve and, after passing over the individual's shoulders, are attached to the chair central-crossmember. The seat is held in the folded position by means of a cord extending from the sleeve which is tied around the seat front-crossmember.

4 Claims, 3 Drawing Sheets

FOLDING CHAIR BACKPACK

TECHNICAL FIELD

This invention relates to backpack type carrying devices, and more particularly to such a device specially designed for transporting folding lawn chairs.

BACKGROUND ART

The prior art is replete with backpack type devices designed to enable individuals to carry a myriad of different objects about while keeping their hands free for other purposes. U.S. Pat. No. 4,487,345 discloses a backpack with a folding chair that forms an integral part of the backpack frame. U.S. Pat. No. 4,972,981 discloses a Folding Chair Backpack that is comprised of a lengthy sheet of material having side straps for enclosing one or more chairs to be carried by means of straps encircling the individual's shoulders. While both of these devices are quite useful, they are also more complex and/or difficult to use than is really necessary to accomplish the simple function of easily transporting a folding lawn chair.

DISCLOSURE OF THE INVENTION

The present invention discloses a device for attachment to a standard folding lawn chair for subsequent transportation on an individual's back. The device utilizes a padded sleeve which slips over the back of the chair, and within which are a pair of fasteners which are secured to the seatback upper-crossmember. A pair of shoulder straps, integral with the fasteners, extend from the padded sleeve and, after passing over the individual's shoulders, are attached to the chair's central-crossmember. The seat is held in the folded position by means of a cord extending from the sleeve which is tied around the seat front-crossmember.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 3:
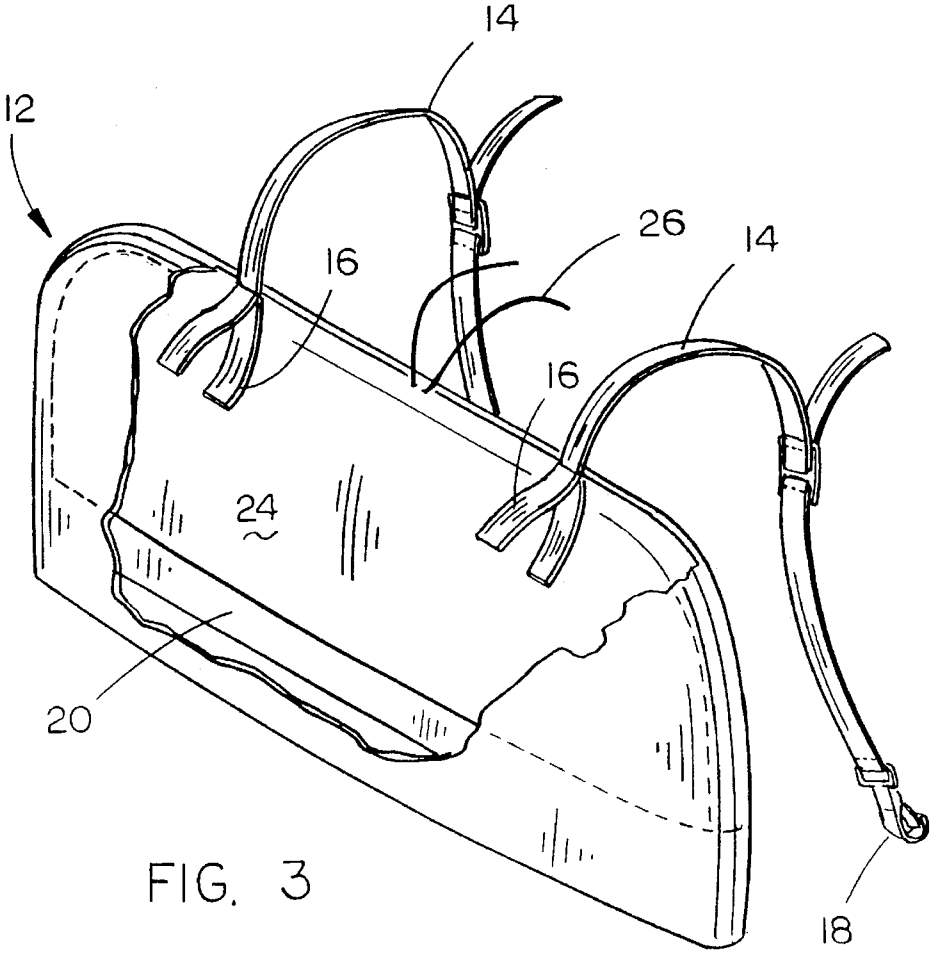
FIG. 3 is a perspective, partially cutaway view of the invention which shows the interior of the seatback sleeve.
Figure 1:
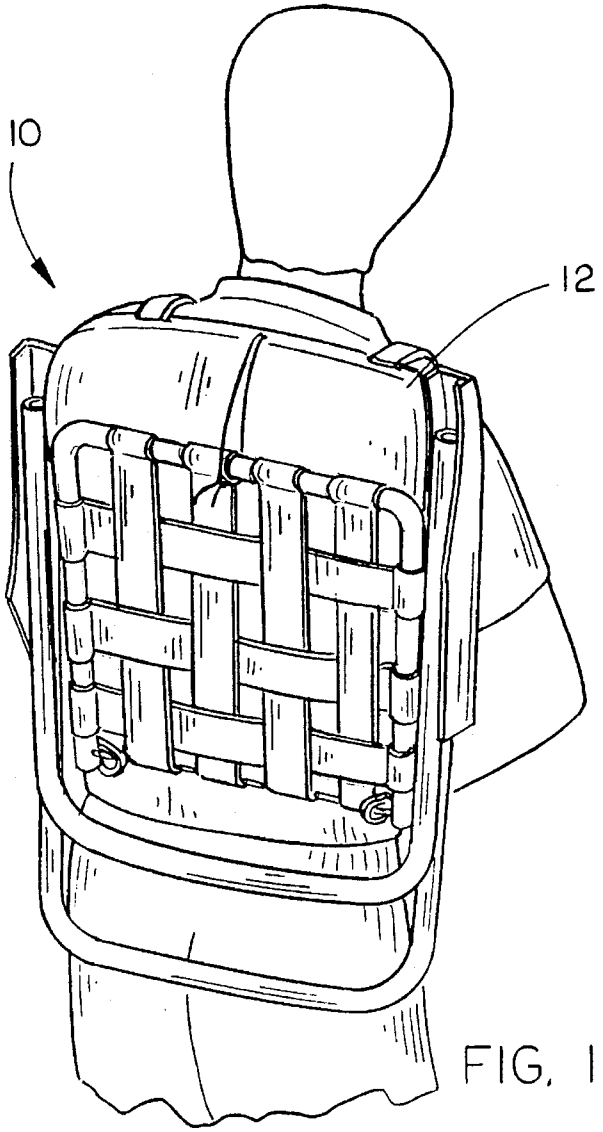
FIG. 1 is a perspective view of the invention in use.
Figure 2:
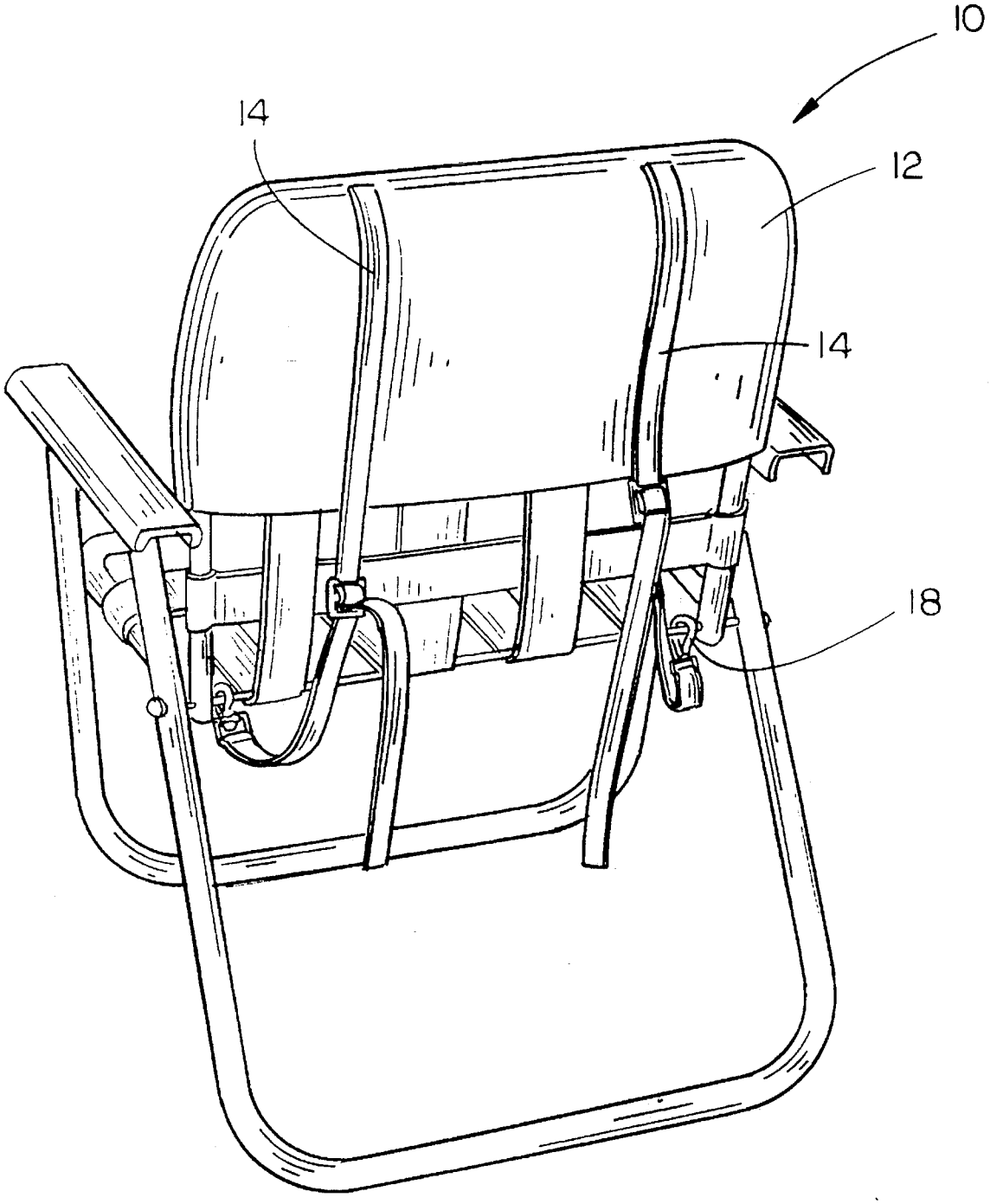
FIG. 2 is a perspective view of a lawn chair with the invention still attached.
Figure 5:
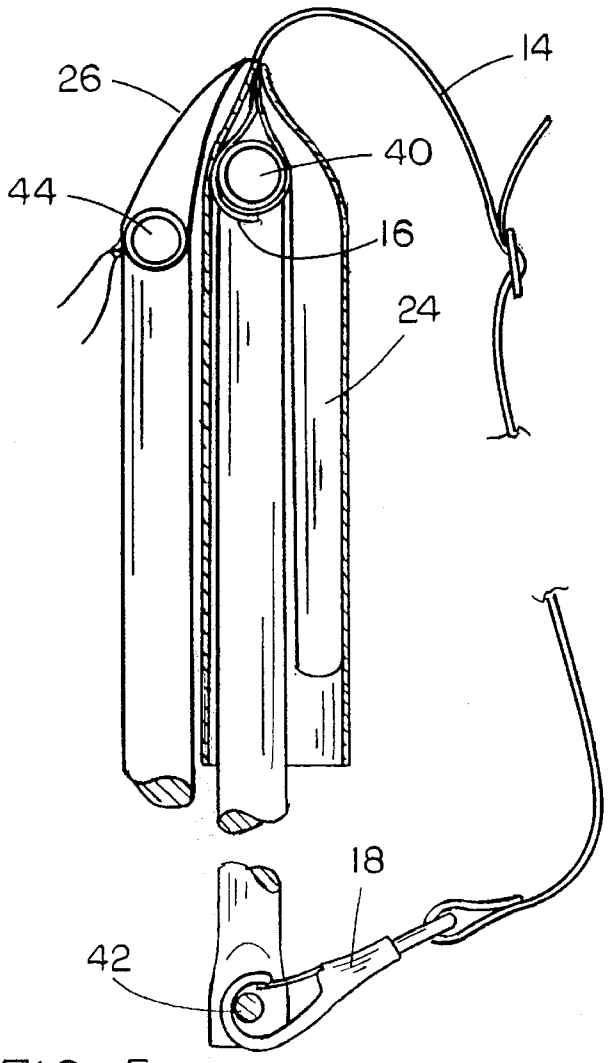
FIG. 5 is a partial cross-sectional view of the invention in place on a chair.
Figure 4:
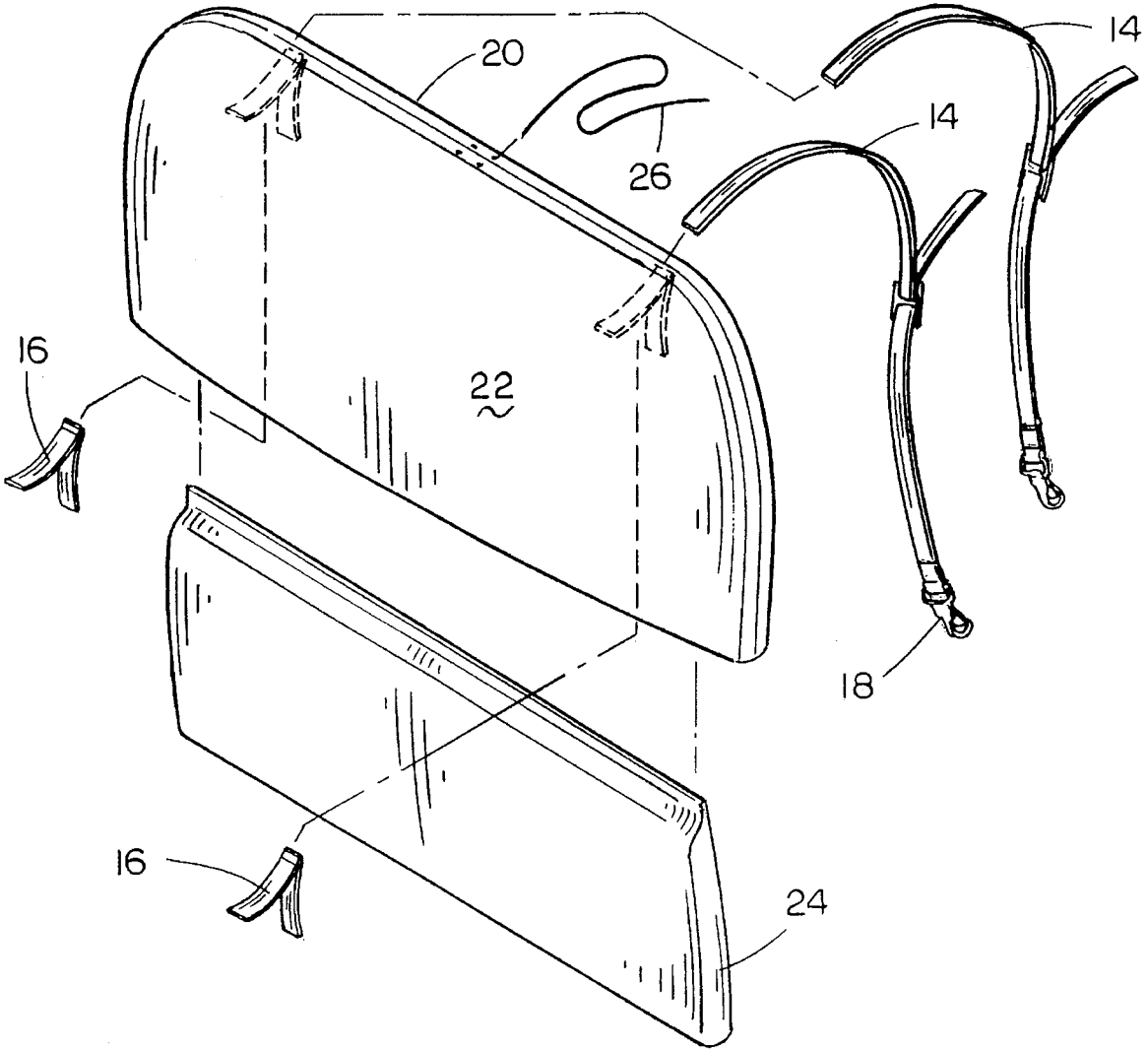
FIG. 4 is an exploded view of the invention.

The invention is depicted at 10 in FIGS. 1 and 2, in which it is attached to a standard folding lawn chair. FIG. 1 shows the chair positioned upon an individual's back for transportation, while FIG. 2 shows the chair in the sitting position. Best seen in FIGS. 3 and 4, the invention 10 generally comprises a seatback sleeve 12 and a pair of adjustable length shoulder straps 14. The upper ends of the shoulder straps 14 are sewn or otherwise secured to a pair of hook and loop fastener strips 16 which are secured about the seatback upper-crossmember 40 (FIG. 5). The lower ends of the shoulder straps 14 are fitted with snap clips 18 which are secured about the chair central-crossmember 42.

The seatback sleeve 12 is constructed from a pair of panels 20, 22 of sturdy fabric or similar material which are sewn together along their sides and upper contour. Within the seatback sleeve 12 is sewn a backpad 24, preferably of thin foam rubber, which serves to cushion the impact of the chair against the carrier's shoulders during transportation. During the sewing process, which is best performed with the panels 20, 22 inside out, the hook and loop fastener strips 16 are sewn through the seam of the sleeve 12 as can clearly be seen in the Figures. This allows the weight of the chair to be borne by the shoulder straps 14 and not by the seatback sleeve 12.

Secured to the seatback sleeve 12 is a cord or strap 26 which may be fastened about the seat front-crossmember 44 to hold the chair in the folded position during transportation.

Obviously, many modifications and variations of the present invention are possible in light of the above teachings. For example, the hook and loop fastener strips 16 could easily be replaced by other fastening means, as could the snap clips 18. It is therefore to be understood that, within the scope of the appended claims, the invention may be practiced otherwise than as specifically described within this description of the best mode for carrying out the invention.

What is claimed is:

1. A device for transporting folding chairs having seatbacks and seats, comprising:

(a) a seatback sleeve having a closed end and an open end dimensioned to receive the seatback of a folding chair; and (b) left and right shoulder straps, each having a first end and a second end, each of said first ends attached to said closed end of the seatback sleeve and having first fastener means extending within said seatback sleeve adapted for attachment to a seatback upper-crossmember of said chair, and each of said second ends having second fastener means adapted for attachment to a central cross-member of said chair.

2. The device as recited in claim 1, further comprising a backpad secured within the closed end of said seatback sleeve and disposed adjacent said first fastener means.

3. The device as recited in claim 1, further comprising tether means on the exterior surface of said seatback sleeve for securing said chair in a folded position.

4. The device as recited in claim 1, wherein said first fastener means comprises a strip of hook fastener material and a strip of loop fastener material.

* * * * *